US011371251B1

(12) United States Patent
Koolmeister

(10) Patent No.: US 11,371,251 B1
(45) Date of Patent: Jun. 28, 2022

(54) CLIMATE SHELTER

(71) Applicant: Miles Koolmeister, Champlin, MN (US)

(72) Inventor: Miles Koolmeister, Champlin, MN (US)

( * ) Notice: Subject to any disclaimer, the term of this patent is extended or adjusted under 35 U.S.C. 154(b) by 0 days.

(21) Appl. No.: 17/235,676

(22) Filed: Apr. 20, 2021

Related U.S. Application Data

(60) Provisional application No. 63/013,469, filed on Apr. 21, 2020.

(51) Int. Cl.
*E04F 17/00* (2006.01)
*E04F 10/04* (2006.01)

(52) U.S. Cl.
CPC ..... *E04F 17/00* (2013.01); *E04F 10/04* (2013.01)

(58) Field of Classification Search
CPC ..... E04F 17/00; E04F 10/04; E04D 13/0404; E04D 13/0409; E04D 13/0477; E04D 2013/0826
See application file for complete search history.

(56) References Cited

U.S. PATENT DOCUMENTS 5,315,090 A 5/1994 Lowenthal
5,865,498 A 2/1999 Grogan
6,244,007 B1 * 6/2001 Heikkila ..... E04D 3/30 52/537
6,488,069 B1 12/2002 Mashaw
6,796,092 B1 * 9/2004 Goebel ..... E04F 15/02 52/302.1
7,331,357 B2 * 2/2008 Huff ..... E04F 17/00 52/302.1
7,882,663 B2 2/2011 Borgerding
8,132,583 B2 3/2012 Mowatt
8,341,892 B2 1/2013 Tugnoli
8,973,313 B2 * 3/2015 Bettiol ..... E04D 13/0477 52/302.1
9,328,516 B2 * 5/2016 Albert ..... E04F 10/005
9,453,338 B1 * 9/2016 Gobeil ..... E04F 15/02183
9,562,353 B2 * 2/2017 Bettiol ..... E04H 1/005
9,725,922 B2 8/2017 Dyeson
9,988,818 B1 * 6/2018 Tanghongs ..... E04D 13/0643
10,392,821 B2 * 8/2019 Volin ..... E04B 1/19
10,533,337 B2 1/2020 McKibben
10,842,126 B1 2/2020 Volin
2005/0072081 A1 * 4/2005 Goebel ..... E04D 13/0477 52/302.1

(Continued)

*Primary Examiner* — Rodney Mintz
(74) *Attorney, Agent, or Firm* — Vidas, Arrett & Steinkraus; Edwin E. Voigt, II

(57) ABSTRACT

A climate shelter has a cover defining a valence and a moisture diverter proximate to a horizontal support. A side panel is releasably secured to the cover under the valence. The side panel includes a slot passage interior relative to the valence. The moisture diverter has an opening, a plurality of downwardly converging passage walls, and a moisture chute extending downwardly and outwardly relative to the walls. At least a portion of the moisture chute extends outwardly through the slot passage. Moisture contacting the cover enters the opening and is directed downwardly and outwardly by the walls into the moisture chute, and then outwardly for discharge exterior to a side panel. A portion of the discharge chute is disposed between the side panel and the valence.

11 Claims, 3 Drawing Sheets

(56) References Cited

U.S. PATENT DOCUMENTS

| | | | | |
|---|---|---|---|---|
| 2006/0186697 | A1 | 4/2006 | Whitcomb | |
| 2007/0039650 | A1* | 2/2007 | Huff | E04B 9/00 137/312 |
| 2008/0135187 | A1 | 6/2008 | Weddell | |
| 2012/0204921 | A1 | 4/2012 | Mowatt | |
| 2012/0286095 | A1 | 11/2012 | Giamati | |
| 2013/0104994 | A1* | 5/2013 | Bettiol | E04B 1/12 137/357 |
| 2015/0101260 | A1 | 4/2015 | Albert | |
| 2015/0143757 | A1* | 5/2015 | Bettiol | E04B 1/941 52/302.1 |
| 2016/0230411 | A1* | 8/2016 | Dyeson | E04H 15/58 |
| 2019/0100933 | A1 | 4/2019 | Volin | |
| 2019/0169871 | A1 | 6/2019 | McKibben | |
| 2019/0284831 | A1 | 9/2019 | Volin | |
| 2020/0115917 | A1 | 4/2020 | McKibben | |

* cited by examiner

CLIMATE SHELTER

CROSS-REFERENCE TO RELATED APPLICATIONS

This application claims the benefit of U.S. Provisional Patent Application Ser. No. 63/013,469 filed Apr. 21, 2020, which is incorporated by reference herein in its entirety.

FIELD OF THE INVENTION

The invention relates to climate shelters having a frame structure supporting one or more top coverings and one or more side panels. One or more moisture diverters may be integral with the one or more top coverings where a portion of each moisture diverter passes through an adjacent side panel to the exterior thereof. Moisture entering the moisture diverters redirect accumulated water outwardly, to the exterior of a side panel and exterior to the climate shelter.

BACKGROUND

In the past awnings, canopies, as well as quick assembly sunshades, and the like, have included fabric coverings positioned over a frame. The frames frequently include legs, upper horizontal supports extending between the tops of the legs, and cover supports extending upwardly from the top of the legs and the horizontal supports.

In many instances these components include quick erection connections and retractable/expandable joints to facilitate placement into an operative position. The known connections enable disassembly and transportation of the device to be significantly improved.

In the event that rain or other moisture falls upon an awning, canopy, or sunshade, as previously placed in an operative position, the rain or moisture would descend to the exterior of the fabric cover, due to the slope of the cover supports, towards the horizontal supports. In some instances the moisture would pass over the horizontal supports. In other instances some of the moisture would pass over some of the horizontal supports, and some of the moisture would accumulate as a pocket of moisture on the cover adjacent, but interior to, the horizontal supports.

In the event that pockets of moisture were formed on a cover interior to a horizontal support, an individual was frequently required to use a makeshift or available device having an elongate handle and head which was used to push upwardly upon the underside of the cover and pocket of moisture in order to elevate the cover and moisture over the horizontal support, to effectuate moisture runoff over the top of the horizontal support. During this activity an undesirable volume of moisture would fall during a short period of time adjacent to an individual, causing splashing, and in turn causing the individual to become wet.

The use of an elongate handle and head to elevate a moisture pocket on a cover also frequently exposed the cover to damage.

In the past, individuals have attempted, with very limited success, to use gutters to divert moisture off of a cover. In these instances frequently moisture pockets continued to form adjacent to a horizontal support and/or moisture passed between the horizontal support and failed to enter the gutter for diversion to a different location.

In some instances in the past individuals have attempted to clip gutters to a cover adjacent to a horizontal support. Also in the past the devices which were used to attempt to divert water or moisture relative to a cover over a frame structure were formed of multiple components. The multiple components frequently failed at the junctions between adjacent components, or the components failed to operate in a cohesive intended manner to divert moisture runoff from the exterior of a cover.

None of the known moisture diversion devices have been successful to minimize the creation of moisture pockets occurring on a cover placed over a frame structure. None of the known moisture diversion attempts have been successful in diverting moisture to a desired location relative to the exterior cover and frame structure.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entireties.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

In at least one embodiment, a climate shelter includes quick release connection and assembly components to form a frame structure. The frame structure being formed of a plurality of vertical legs, a plurality of horizontal supports extending between the vertical legs and a plurality of cover supports extending angularly and upwardly from either the horizontal supports or the vertical legs forming an upper area.

In at least one embodiment, a top cover formed of a moisture repellent material is disposed over the cover supports. The top cover has a top section covering the upper area and a lower section covering the horizontal supports. The lower section is of sufficient length to overlap over the horizontal supports and extend downwardly towards the ground or other surface to form a valance section.

In at least one embodiment, the valance section has a bottom edge and the top cover has a cover interior and a cover exterior.

In at least one embodiment, a horizontally extending top cover zipper section is engaged to the cover interior of the upper portion of the valance section. The horizontally extending top cover zipper section, when the top cover is placed upon the frame structure in an operative position, is located below a horizontal support.

In at least one embodiment, a plurality of side panels are releasably engaged to the top cover by the use of mating side panel top zipper sections. The side panel top zipper sections extend across the top of the side panels. The side panels descend/hang from the top cover downwardly towards the ground or other surface.

In at least one embodiment, the side panels include a side panel top edge having the side panel top zipper sections, a side panel left edge, a side panel right edge, and a side panel bottom edge. The side panels are also preferably formed of moisture repellent material.

In at least one embodiment, each of the side panels includes at least one slot passage. The slot passages extend completely through the side panels. The slot passages are located below the side panel top edge and are at a sufficient elevation to be higher than the bottom edge of the valance section when the top cover is in the operative position over the frame structure.

In some embodiments, the slot passage is covered by the valance section when the side panels are releasably engaged to the top cover.

In at least one embodiment, a moisture diverter is engaged to the lower section of the top cover. The moisture diverter is positioned on the top cover above the horizontal supports. The moisture diverter provides an opening and a moisture passage through the top cover.

In some embodiments, when moisture falls upon the top cover as placed in an operative position, the moisture will descend along the top cover and over the horizontal supports and downwardly over the exterior surface of the valance section. In alternative embodiments, not all of the moisture exposed to a top cover will descend over the horizontal supports. The moisture not passing over the horizontal supports will be drawn by gravity towards the moisture diverter.

In some embodiments, the moisture diverter includes a passage opening, a plurality of downwardly converging and outwardly extending passage walls, and a moisture chute in fluid flow communication with the passage walls. The moisture chute extends downwardly and outwardly relative to the passage opening and passage walls. At least a portion of the moisture chute and the discharge opening of the moisture chute pass through the slot passage of a side panel.

In some embodiments, the top cover when located in the operative position, disposes the moisture chute and discharge opening through the slot passage of a side wall, where moisture exposed to the top cover which does not traverse over the top of the horizontal supports will enter the moisture diverter and exit the fluid passage on the exterior of a side panel.

In some embodiments, moisture exiting the discharge chute will be proximate to and underneath the interior surface of the downwardly extending valance section.

In some embodiments, the passage opening may be substantially triangular, circular, or rectangular in shape.

In some embodiments the passage opening may include a moisture opening cover to prevent debris or vegetation from entering the moisture passage.

In some embodiments, the moisture diverter will be formed of the same material as the top cover.

In some embodiments the moisture chute is substantially tubular in shape. The moisture chute may include mating hook and loop material on an upper exterior surface to releasably engage mating hook and loop material on the interior surface of the valance section.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

Figure 1:
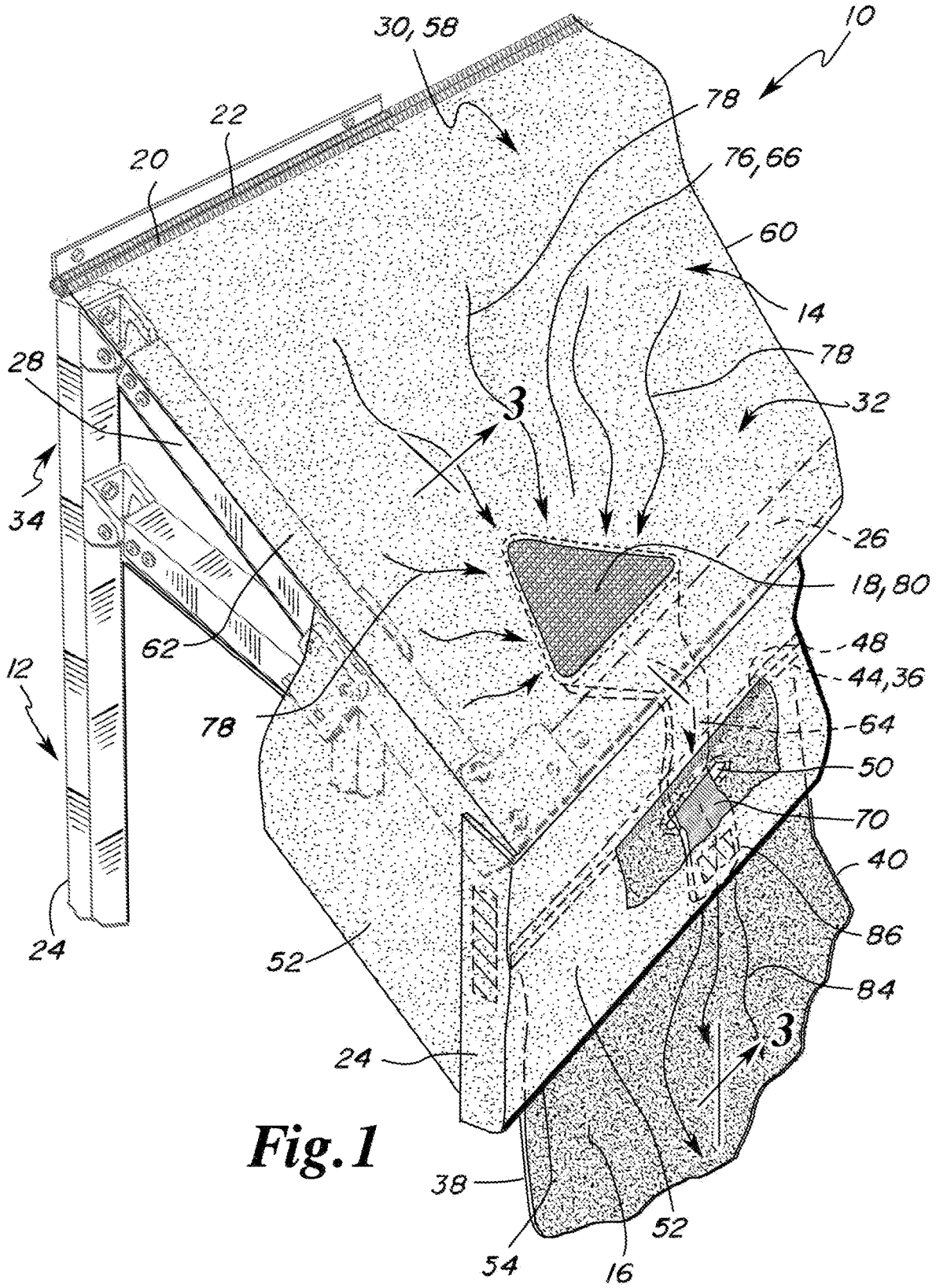
FIG. 1 is a partial isometric perspective view of an embodiment of a Climate Shelter showing a frame structure, a top cover, and a side panel.

In at least one embodiment, a portion of a climate shelter 10 is depicted in FIG. 1. As may be seen in FIG. 1 the climate shelter 10 may be formed of quick release connection and assembly components which are more fully described in commonly owned U.S. patent application Ser. No. 16/439,249, as filed on Jun. 12, 2019, entitled Connection Device For Mobile Frame Structures, as well as U.S. patent application Ser. No. 17/106,847, as filed on Nov. 30, 2020, entitled Releasable Connection Frame Assembly, the entire contents and disclosure for both of which being incorporated by reference herein in their entireties.

In at least one alternative embodiment as may be seen in FIG. 1, the climate shelter 10 is formed of a frame structure 12. The frame structure 12 includes a plurality of vertical legs 24, a plurality of horizontal supports 26, and a plurality of cover supports 28. A top cover 14 is positioned in a covering relationship over the frame structure 12.

Figure 2:
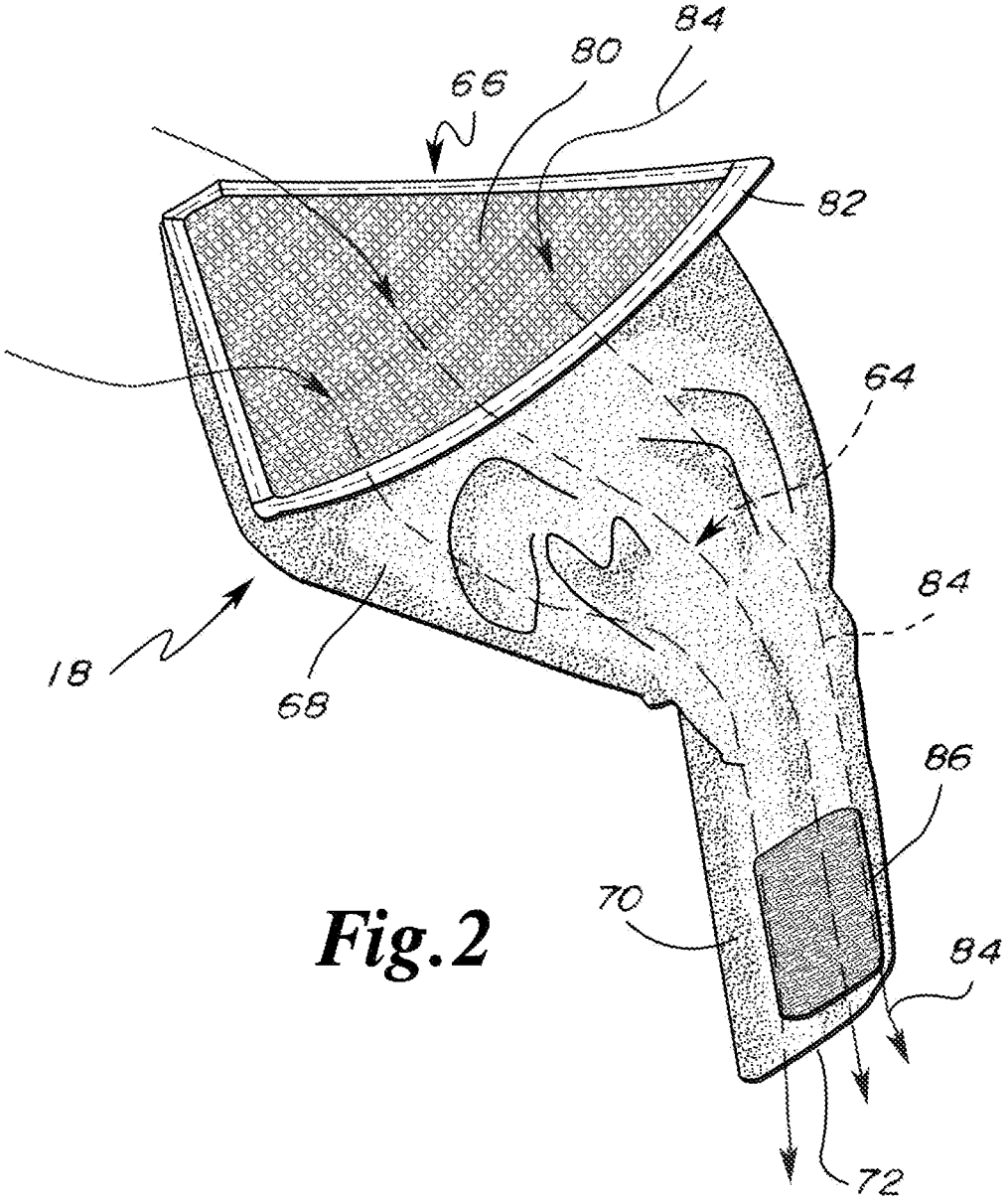
FIG. 2 is a detail isometric perspective view of an embodiment of the moisture diverter.
Figure 3:
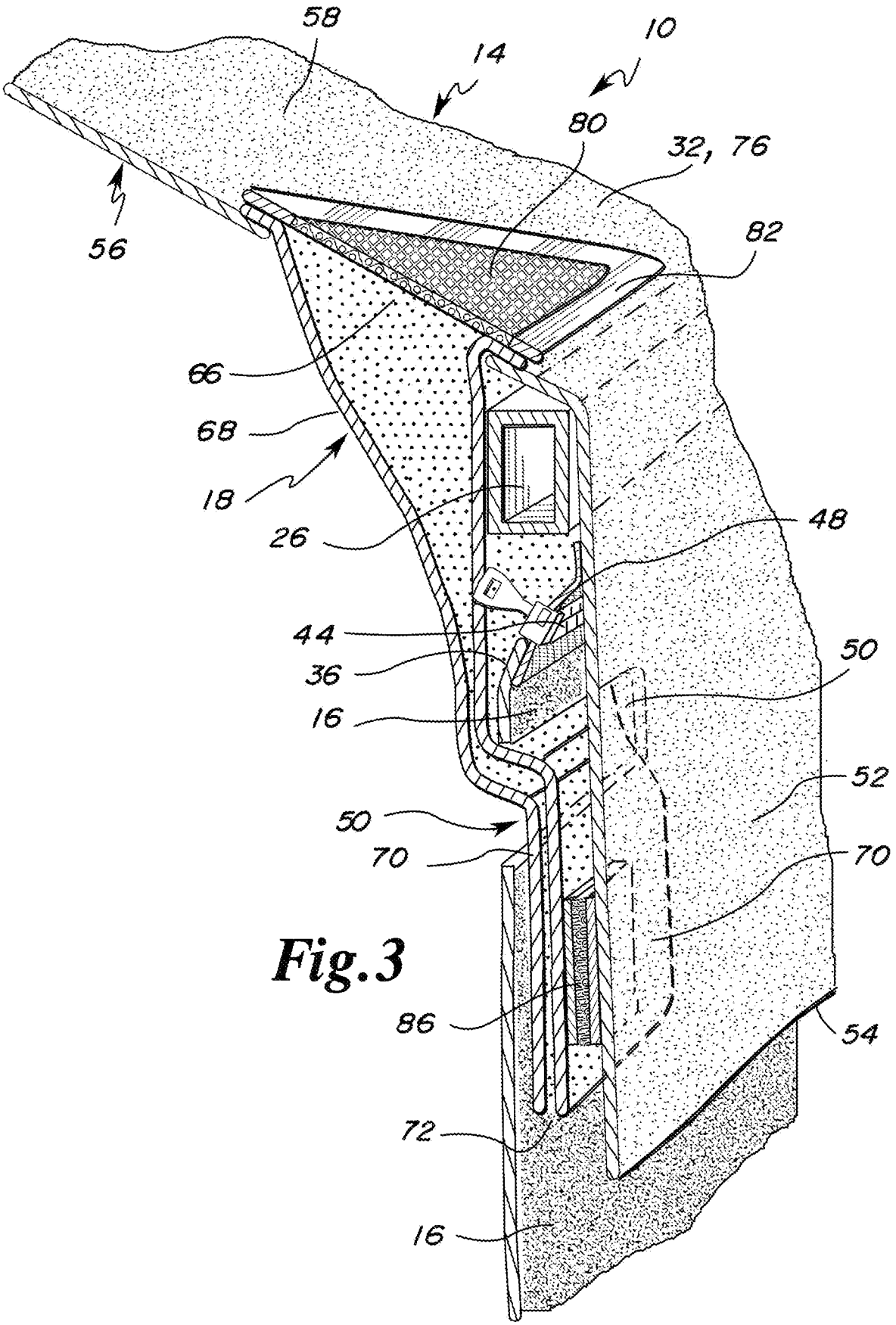
FIG. 3 is a detail partial cross-sectional isometric perspective view of an embodiment of a Climate Shelter taken along the line 3-3 of FIG. 1.

In general, referring to FIGS. 1 through 3, in a preferred embodiment the top cover 14 is formed of moisture resistant and/or moisture repellent material. The materials selected for the top cover 14 may be naturally resistant or repellent of moisture, or may be treated with a moisture resistant or repellent substance or coating, or may be both naturally resistant or repellent and treated with a resistant or repellent substance to provide the required specifications for moisture security as desired by an individual. In general, the materials selected to form the top cover 14 will be of sufficient quality and durability to not rip, tear, fracture and/or fail to perform its intended purpose when exposed to an adverse weather environment.

In some embodiments, the materials selected to form the top cover 14 may be canvas, cotton, nylon, rayon, natural fibers, synthetic fibers, natural fiber blends, synthetic fiber blends and any combination of any one or more of the above identified material or fibers.

In at least one embodiment, the frame structure 12 may be configured to provide an awning or canopy, a tent, an enclosure, or any other shape or type of climate shelter 10 as desired by an individual. In general, the size dimensions selected for the plurality of vertical legs 24, plurality of horizontal supports 26, and/or plurality of cover supports 28 will vary dependent upon the requirements of an individual application. It is anticipated that any number of substantially identical components may be disposed and connected in any adjacent relationship to satisfy the needs of a user application and/or to form a desired perimeter and cover for a climate shelter 10.

In some embodiments, the top cover 14 is a unitary component which includes a upper section 30 as well as a lower section 32. The upper section 30 of the top cover 14 is located proximate to and in covering relationship over the upper area 34 of the frame structure 12. The upper section 30 is generally the top of the climate shelter 10 and may define an angle surface, or may define the highest portion of a freestanding climate shelter 10, which may be of any size or shape.

In at least one alternative embodiment, the top cover 14 may include a top cover upper edge 20 having a top cover attachment 22. The top cover attachment 22 may be a cylindrical protrusion on the end of a flange designed to slidably pass within a channel as affixed to a vertical wall surface. The top cover attachment 22 facilitates the ease of assembly and disassembly of the top cover 14 into an operative position. In another embodiment, the top cover attachment 22 may be a zipper portion for engagement to another zipper portion as previously engaged to a vertical wall surface.

In at least one embodiment, the top cover 14 may be removed from a folded or stored position for quick placement into an operative position through the use of the top cover attachment 22. The top cover attachment 22 in alternative embodiments may be other types of mechanical fasteners such as T-clips and eyeholes or any other type of mechanical fastener so long as the desired function of quick assembly, disassembly, storage and prolonged useful life are provided for the top cover 14 during periods of use and nonuse.

In some embodiments, the top cover 14 may be substantially rectangular, square or any other shape as desired. In other embodiments, the top cover 14 may be triangular in shape with the narrow portion of the triangle disposed upwardly forming the upper section 30.

In at least one alternative embodiment, the top cover 14 will include a top cover right side edge 60 and/or a top cover left side edge 62. Each of the top cover right side edge 60 and top cover left side edge 62 may include a mating top cover side edge attachments. A top cover 14 may thereby perform as a section of a larger climate shelter 10 through the adjacent placement of two top covers 14 adjacent to each other and the releasable affixation of a top cover right side edge 60 to a top cover left side edge 62 through the use of the top cover side edge attachments. The climate shelter 10 may therefore be of any desired length or width dimension or shape.

In another embodiment, the top cover 14 includes a cover exterior 58 as well as a cover interior 56. Moisture exposed to the top cover 14 while placed in an operative position will contact the cover exterior 58 and moved by gravity downwardly along the cover exterior 58 towards the plurality of horizontal supports 26. A volume of the moisture may directly pass over the lower section 32 and the plurality of horizontal supports 26, and descend downwardly along the valence section 52 to fall onto a ground or other surface. A second volume of moisture exposed to the cover exterior 58 may alternatively descend downwardly to a reduced depth moisture pocket area 76 as depicted by arrows 78.

In at least one embodiment, the moisture pocket area 76 will be located in the lower section 32 proximate to and above a horizontal support 26. As may be seen in FIG. 1, a moisture diverter 18 is disposed in the bottom of the moisture pocket area 76.

In some embodiments, the lower section 32 is disposed below the upper section 30 and when placed into an operative position is adjacent to and above a plurality of horizontal supports 26. The upper section 30 is the location where a potential exists for moisture to accumulate such as a moisture pocket area 76 when moisture contacts the cover exterior 58. The lower section 32 is also the location where a moisture diverter 18 may be affixed to the top cover 14.

In a preferred embodiment, the lower section 32 passes over the exterior of a plurality of horizontal supports 26 and extends downwardly therefrom transitioning into a valence section 52. The dimension between a bottom edge 54 of a valence section 52 and the plurality of horizontal supports 26 will vary dependent upon the requirements of a particular application. In many applications the dimension between the bottom edge 54 and a plurality of horizontal supports 26 will be equal to, or greater than, 12 inches or equal to, or less than, 30 inches. In alternative embodiments, however, the distance dimension between the bottom edge 54 and plurality of horizontal supports 26 may be less than 12 inches or greater than 30 inches dependent upon the requirements of the specific application.

In some embodiments, the valence section 52 provides a cover extension to expand a fluid course for moisture contacting the cover exterior 58 over a plurality of horizontal supports 26. The dimension of the valence section 52 is sufficiently large so that moisture does not enter into an interior of a climate shelter 10 at a junction between a plurality of vertical side panels 16 and a top cover 14.

In addition, in at least one embodiment, the valence section 52 adds mass to the top cover 14 and uses gravity to assist in keeping the top cover 14 taught relative to the frame structure 12 in the operative position. The additional mass of the valence section 52 drawing the top cover 14 downwardly over the exterior of the plurality of horizontal supports 26, reduces the likelihood of the formation of an undesirable moisture pocket area 76 in the lower section 32 above one of the horizontal supports 26.

The valence section 52, like the top cover 14, includes a cover interior 56. In some embodiments, the horizontally extending top cover zipper section 48 is secured to the cover interior 56 by stitching. The horizontally extending top cover zipper section 48 is preferably disposed at a dimension of at least 1 inch, and preferably more than 3 inches, below a horizontal support 26. The horizontally extending top cover zipper section 48 may be one half of a heavy duty zipper which is used to releasably secure a vertical side panel 16 to the top cover 14.

In some embodiments, the horizontally extending top cover zipper section 48 is not required to be a zipper and may alternatively be any type of mechanical attachment method or device including the use of hook and loop material or channels and mating insertion members. The horizontally extending top cover zipper section 48 functions to provide releasable attachment of a plurality of vertical side panels 16 to a top cover 14 to facilitate installation into an operative position and to facilitate disassembly and folding or rolling for storage of the climate shelter 10.

In some embodiments, at the opposite ends of a climate shelter 10, a horizontal support 26 may not be provided. In this embodiment a cover support 28 and one or more vertical legs 24 may be the most outward components of the frame structure 12. In this embodiment, the top cover 14 may also include a valence section 52 as earlier described. The valence section 52 in this embodiment will extend from a position adjacent to an exterior lower corner between a cover support 28, a horizontal support 26, and a vertical leg 24 angularly upwardly matching the slope of the outermost cover support 28 from the lower section 32 upwardly to the top of the upper section 30. In this embodiment, the horizontally extending top cover zipper section 48 will also be engaged to the cover interior 56 of the valence section 52 as earlier described and extend angularly upwardly matching the slope of a cover support 28.

In a preferred embodiment, a plurality of vertical side panels 16 are secured to a top cover 14 during assembly of the climate shelter 10. A vertical side panel 16 is preferably formed of the identical material as the top cover 14 including the moisture repellent specifications as previously described. In at least one alternative embodiment, a vertical side panel 16 is not required to be formed of the same material as the top cover 14, dependent upon the requirements of a particular application. For example, in a wedding environment a top cover 14 may be formed of a standard water repellent material and a vertical side panel 16 may be formed of a lightweight, sheer, or partially transparent material to provide a unique and aesthetically pleasing environment. The description herein for the plurality of vertical side panels 16 will be made for embodiments where the materials selected is identical or substantially identical to the material used for the top cover 14.

In many embodiments, the plurality of vertical side panels 16 will include a side panel top edge 36, a side panel left edge 38, a side panel right edge 40 and a side panel bottom edge. One or more of the side panel top edges 36, side panel left edges 38, and side panel right edges 40 may include mechanical attachment elements which may be zippers and/or hook and loop fabric material, or other types of mechanical attachment mechanisms or devices to join adjacent side panels 16 together in the formation of a climate shelter 10.

In one embodiment, one or more of the plurality of vertical side panels 16 will include a side panel top zipper section 44 along a side panel top edge 36. The side panel top zipper section 44 couples with the horizontally extending top cover zipper section 48 to releasably secure a side panel 16 to the top cover 14.

In at least one alternative embodiment, the vertical legs 24 have a sufficient height dimension, and the vertical side panels 16 have a substantially matching height dimension to place the side panel bottom edge proximate to a ground or other surface. In this embodiment, the mass of the vertical side panels 16, as engaged to the horizontally extending top cover zipper section 48, exerts a downward force upon the top cover 14. The downward force resulting from the mass of the vertical side panels 16 is transferred to the top cover 14, causing the top cover 14 to become taught relative to the upper area 34 of the frame structure 12. The taught configuration of the top cover 14 relative to the frame structure 12 minimizes the formation of undesirable and unanticipated moisture pocket areas 76 in the lower section 32 upon exposure to moisture. The taught configuration of the top cover 14 relative to the frame structure 12 facilitates the flow of moisture downwardly from the top cover 14 towards and over the horizontal supports 26 and to the exterior of the valence section 52.

In some alternative embodiments, a side panel right edge 40 of an initial side panel 16 may be releasably coupled to a side panel left edge 38 of an adjacent side panel 16 to form a section and elongated side wall for a climate shelter 10. In other embodiments a side panel right edge 40 of an initial side panel 16 may be releasably coupled to a side panel left edge 38 of an adjacent side panel 16 to form a corner for the climate shelter 10. In another embodiment, the side panel bottom edge of an initial side panel 16 may be releasably coupled to a side panel top edge 36 for an adjacent side panel 16 to form a side wall of extended height for a tall climate shelter 10.

In at least one alternative embodiment, each of the vertical side panels 16 will include at least one slot passage 50. The slot passage 50 completely traverses the vertical side panel 16 establishing a passage therethrough. The slot passage 50 is preferably positioned adjacent to and below a side panel top edge 36. The distance dimension of the slot passage 50 below the side panel top edge 36 will vary dependent on the requirements of a particular application. However, the distance dimension of the slot passage 50 below the side panel top edge 36 will not be so large as to locate the slot passage 50 below the level of, or downwardly relative to, the bottom edge 54 of the valence section 52. Preferably the distance dimension of the slot passage 50 below the side panel top edge 36 will dispose the slot passage 50 centrally relative to the bottom edge 54 and the height dimension of a horizontal support 26.

In some embodiments, the width dimension selected for the slot passage 50 will vary dependent on the requirements of a particular application. In a preferred embodiment the width dimension selected for the slot passage 50 will exceed the width dimension of moisture chute 70 of the moisture diverter 18.

In some embodiments, a ground or other surface below a climate shelter 10 may not be level. In this instance, the downward force or pressure exerted by the mass of the vertical side panels 16 upon the top cover 14 may not be evenly distributed onto the top cover 14. In this situation one or more moisture diverters 18 may be included in the top cover 14 in the lower section 32 upwardly from a horizontal support 26 of the frame structure 12.

In at least one alternative embodiment, a climate shelter 10 may omit one or more vertical side panels 16 in order to establish doorways into the interior of the climate shelter 10. Alternatively, a side panel right edge 40 of an initial side panel 16 is not required to be coupled to a side panel left edge 38 of an adjacent side panel 16 in order to establish a doorway into a climate shelter 10.

Referring to FIG. 1, in at least one alternative embodiment, a designated moisture pocket area 76 includes a passage opening 66 of a moisture diverter 18. The passage opening 66 may also include a moisture opening cover 80 to prevent leaves and/or other types of vegetation from entering and clogging the moisture diverter 18. The moisture diverter 18 preferably includes a perimeter flange 82. (FIG. 2) The perimeter flange 82 may be sewn to the top cover 14 and may be sealed to prevent moisture leakage. The passage opening 66 traverses the cover exterior 58 and cover interior 56 defining the inlet for the moisture passage 64 established by the moisture diverter 18.

In some alternative embodiments, the passage opening 66 may be triangular or substantially triangular in shape. In alternative embodiments, the passage opening 66 may be rectangular, square, circular, oval, or any other shape as desired by an individual.

In some embodiments, the moisture opening cover 80 is formed of mesh material having sufficient opening sizes to permit the free flow of moisture into the moisture diverter 18 while simultaneously stopping leaves or other vegetation from entering into and potentially clogging the moisture passage 64.

In a preferred embodiment, the moisture diverter 18 includes the passage opening 66, perimeter flange 82, moisture opening cover 80, plurality of passage walls 68, and the moisture chute 70 having a discharge opening 72. As may be seen in FIG. 1, a portion of the moisture chute 70 and discharge opening 72 passes from the cover interior 56 to the cover exterior 58 through the slot passage 50 of a side panel 16. In this embodiment, the discharge opening 72 is also disposed adjacent to the cover interior 56 of the valence section 52 at a higher elevation than the bottom edge 54. The lower portion of the moisture chute 70 and the discharge opening 72 are therefore in a sandwiched position relative to a vertical side panel 16 and the valence section 52. A volume of moisture contacting the cover exterior 58 may descend, represented by arrows 78, towards the moisture pocket area 76 and the passage opening 66. Moisture will then pass through the moisture opening cover 80 and be funneled downwardly and outwardly toward the exterior of the perimeter of the frame structure 12 by the plurality of inwardly converging passage walls 68. The moisture will continue a downward and outward movement along the moisture passage 64 entering the moisture chute 70. As the moisture continues along the moisture passage 64 within the moisture chute 70 the moisture exits from the cover interior 56 of the top cover 14 to the exterior of a vertical side panel 16. The moisture may then fall along the exterior of a vertical side panel 16 following a natural water course. The cover interior 56 of the valence section 52 assists in the diversion of moisture downwardly along the exterior of a vertical side panel 16. The moisture diverter 18, by the establishment of a moisture passage 64, prevents the accumulation of moisture upon a top cover 14 in a lower section 32 above a horizontal support 26 and the formation of a moisture pocket.

Referring to FIG. 2, the moisture diverter 18 is shown in additional detail. As may be seen in FIG. 2, in at least one embodiment the plurality of passage walls 68 are integral with the passage opening 66 and perimeter flange 82 the descending downwardly therefrom. The passage walls 68 are angled in a converging downward and outward direction towards a vertical side panel 16 and the slot passage 50. The shape of the passage walls 68 function in a manner similar to a funnel to direct moisture away from the lower section 32 towards a ground or other surface.

In some embodiments, the moisture diverter 18 may be formed of a plurality of plurality of passage walls 68 which are joined together at the respective passage wall edges. Alternatively the passage walls 68 may be formed of a single unitary portion of material.

In some alternative embodiments, the material used to form the moisture diverter 18 is identical, or substantially identical, to the material used to form the top cover 14 and/or the vertical side panels 16 as earlier described herein. It should also be noted that the passage opening 66 may be oriented in any desired direction relative to the top cover 14, provided the moisture chute 70 is directed towards an adjacent perimeter of a side panel 16, aligning the moisture chute 70 with the slot passage 50. More specifically, the moisture diverter 18 as depicted in FIG. 1 may be rotated 90° to the left, to position the moisture chute 70 through a slot passage 50 of an end panel.

In at least one embodiment as shown in FIGS. 1 through 3 the passage opening 66 is shaped and disposed to have a narrow portion upwardly in the direction of the upper area 34 and having a relatively wide portion disposed downwardly proximate to a horizontal support 26. In this positional configuration the accumulation and diversion of moisture within the moisture passage 64 is maximized. It should also be noted that the mass of any moisture in the moisture passage 64 is directed downwardly towards and into the moisture chute 70 and does not cause the moisture chute 70 to be withdrawn upwardly for involuntary withdraw from the slot passage 50.

The lowermost portion of the passage walls 68 function as the base of the moisture passage 64, which terminates at a location which is proximate to the interior of a side panel 16, at the slot passage 50. The passage walls 68 transition into the moisture chute 70 adjacent to the interior of the slot passage 50.

In some embodiments the moisture chute 70 is integral with the passage walls 68 and extends angularly downwardly and forwardly therefrom. In at least one embodiment, the moisture chute 70 is tubular in shape where the shape has been flattened. The moisture chute 70 terminates at the discharge opening 72 which is the outlet for the moisture passage 64 for the moisture diverter 18.

In one alternative embodiment, a portion of hook and loop fabric material 86 may be secured to the exterior of the moisture chute 70. The hook and loop fabric material 86 is disposed on the outer surface of the upper side of the moisture chute 70 and is proximate to the interior of the valence section 52, when the moisture chute 70 passes through the slot passage 50. In this embodiment, the interior side of the valence section 52 includes a matching portion of hook and loop fabric material 86 to releasably coupled the moisture chute 70 to the interior of the valence section 52. The coupling of the hook and loop fabric material 86 of the moisture chute 70 and the hook and loop fabric material 86 of the valence section 52 facilitates the retention of the moisture chute 70 in an aligned orientation relative to the slot passage 50.

In FIG. 2, moisture passing through the moisture passage 64 of the moisture diverter 18 is represented by arrows 84.

In some embodiments as shown in FIG. 3, a detail partial cross-sectional perspective view of the lower section 32, moisture diverter 18, horizontal support 26, passage opening 66, passage walls 68, moisture chute 70, side panel top zipper section 44, horizontally extending top cover zipper section 48, slot passage 50, valence section 52, hook and loop fabric material 86 and vertical side panel 16 is shown in an assembled operative position.

In a first alternative embodiment, a climate shelter is formed of a frame structure, the frame structure having a plurality of vertical legs, a plurality of horizontal supports, and a plurality of cover supports; a top cover, the top cover having a cover interior and a cover exterior, the top cover having a lower section, the top cover being disposed over the plurality of cover supports, the lower section being positioned proximate to and over at least one of the plurality of horizontal supports and extending downwardly therefrom establishing a valence section, the valence section having a bottom edge, the top cover having a horizontally extending top cover zipper section positioned proximate to and below at least one of the plurality of horizontal supports on the cover interior; a plurality of vertical side panels, each of the plurality of vertical side panels having a side panel top edge, at least one of the side panel top edges having a side panel top zipper section, the side panel top zipper section being constructed and arranged for releasable engagement to at least one of the horizontally extending top cover zipper sections, at least one of the plurality of side panels having at least one slot passage, each of the at least one slot passages traversing the at least one of the plurality of side panels below the side panel top zipper section, the valence section being exterior relative to the side panel top zipper section, the at least one slot passage, and a portion of at least one of the plurality of side panels in a first operative position; and at least one moisture diverter, the at least one moisture diverter being engaged to the top cover, the at least one moisture diverter being disposed in the lower section proximate to at least one of the plurality of horizontal supports, the at least one moisture diverter having a passage opening, a plurality of downwardly and converging passage walls, and a moisture chute, the moisture chute extending downwardly and forwardly relative to the plurality of passage walls, the moisture chute having a discharge opening, at least a portion of the moisture chute and the discharge opening extending through the at least one slot passage, wherein a volume of moisture contacting the cover exterior enters the passage opening, the volume of moisture being directed downwardly by the plurality of passage walls and into the moisture chute and outwardly from the discharge opening exterior to at least one of the plurality of side panels, the discharge opening being disposed between at least one of the plurality of side panels and the valence section.

In a second alternative embodiment according to the first alternative embodiment the passage opening is triangular in shape.

In a third alternative embodiment according to the second alternative embodiment the climate shelter includes a moisture opening cover disposed over the passage opening.

In a fourth alternative embodiment according to the third alternative embodiment the moisture chute is formed of fabric material and is tubular in shape.

In a fifth alternative embodiment according to the fourth alternative embodiment the moisture chute includes hook and loop fabric material.

In a sixth alternative embodiment according to the fifth alternative embodiment the cover interior of the valence section includes mating hook and loop fabric material.

In a seventh alternative embodiment according to the fifth alternative embodiment the top cover is formed of fabric material.

In an eighth alternative embodiment according to the fifth alternative embodiment the plurality of side panels are formed of fabric material.

In a ninth alternative embodiment according to the fifth alternative embodiment the at least one moisture diverter is formed of fabric material.

In a tenth alternative embodiment a climate shelter includes a frame structure, the frame structure has a plurality of vertical legs, a plurality of horizontal supports, and a plurality of cover supports, one of the plurality of horizontal supports extending between at least two adjacent of the plurality of vertical legs, and the plurality of cover supports extending angularly upwardly relative to the plurality of horizontal supports; a top cover, the top cover having a cover interior and a cover exterior, the top cover having an upper section and a lower section, the top cover being disposed over the plurality of cover supports, the upper section being proximate to an upper area of the frame structure, the lower section being positioned proximate to and over at least one of the plurality of horizontal supports and extending downwardly therefrom establishing a valence section, the valence section having a bottom edge, the top cover having a horizontally extending top cover zipper section positioned proximate to and below at least one of the plurality of horizontal supports on the cover interior; a plurality of vertical side panels, each of the plurality of side panels having a side panel top edge, a side panel left edge, a side panel right edge and a side panel bottom edge, at least one of the side panel top edges having a side panel top zipper section, the side panel top zipper section being constructed and arranged for releasable engagement to at least one of the horizontally extending top cover zipper sections, at least one of the plurality of side panels having at least one slot passage, each of the at least one slot passages traversing at least one of the plurality of side panels below the side panel top zipper section, the valence section being exterior relative to the side panel top zipper section; and at least one moisture diverter, the at least one moisture diverter being engaged to the top cover, the at least one moisture diverter being positioned on the lower section between the upper section and at least one of the plurality of horizontal supports, the moisture diverter having a passage opening, a plurality of downwardly and converging passage walls, and a moisture chute in fluid flow communication with the plurality of passage walls, the moisture chute extending downwardly and outwardly relative to the plurality of passage walls, the moisture chute having a discharge opening, at least a portion of the moisture chute and the discharge opening extending through the at least one slot passage, wherein a volume of moisture contacting the cover exterior enters the moisture passage through the passage opening, the volume of moisture being directed downwardly and outwardly by the plurality of passage walls and into the moisture chute and outwardly from the discharge opening exterior to at least one of the plurality of side panels, the discharge opening being disposed between at least one of the plurality of side panels and the valence section, the bottom edge being disposed downwardly relative to the discharge opening.

In an eleventh embodiment a climate shelter includes: a frame structure, said frame structure having a plurality of vertical legs, a plurality of horizontal supports, and a plurality of cover supports; a top cover, said top cover having a cover interior and a cover exterior, said top cover having a lower section, said top cover being disposed over said plurality of cover supports, said lower section being positioned proximate to and over at least one of said plurality of horizontal supports and extending downwardly therefrom establishing a valence section, said valence section having a bottom edge, said top cover having a horizontally extending top cover zipper section positioned proximate to and below at least one of said plurality of horizontal supports on said cover interior; at least one vertical side panel, each of said at least one vertical side panel having a side panel top edge, at least one of said side panel top edges having a side panel top zipper section, said side panel top zipper section being constructed and arranged for releasable engagement to at least one of said horizontally extending top cover zipper sections, at least one of said at least one side panels having at least one slot passage, each of said at least one slot passages traversing said at least one of said at least one side panel below said side panel top zipper section, said valence section being exterior relative to said side panel top zipper section, said at least one slot passage, and a portion of at least one of said at least one side panel in a first operative position; and at least one moisture diverter, said at least one moisture diverter being engaged to said top cover in said lower section proximate to at least one of said plurality of horizontal supports, said at least one moisture diverter having a passage opening, a downwardly and converging passage wall, and a moisture chute, said moisture chute extending downwardly and outwardly relative to said passage wall, said moisture chute having a discharge opening, at least a portion of said moisture chute and said discharge opening extending through said at least one slot passage, wherein a volume of moisture contacting said cover exterior enters said passage opening, said volume of moisture being directed downwardly by said passage wall and into said moisture chute and outwardly from said discharge opening exterior to at least one of said at least one side panel, said discharge opening being disposed between at least one of said at least one side panel and said valence section.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

I claim:

1. A climate shelter comprising:

a frame structure, said frame structure having a plurality of vertical legs, a plurality of horizontal supports, and a plurality of cover supports;

a top cover, said top cover having a cover interior and a cover exterior, said top cover having a lower section, said top cover being disposed over said plurality of cover supports, said lower section being positioned proximate to and over at least one of said plurality of horizontal supports and extending downwardly therefrom establishing a valence section, said valence section having a bottom edge, said top cover having a horizontally extending top cover zipper section positioned proximate to and below at least one of said plurality of horizontal supports on said cover interior;

a plurality of vertical side panels, each of said plurality of side panels having a side panel top edge, at least one of said side panel top edges having a side panel top zipper section, said side panel top zipper section being constructed and arranged for releasable engagement to at least one of said horizontally extending top cover zipper sections, at least one of said plurality of side panels having at least one slot passage, each of said at least one slot passages traversing said at least one of said plurality of side panels below said side panel top zipper section, said valence section being exterior relative to said side panel top zipper section, said at least one slot passage, and a portion of at least one of said plurality of side panels in a first operative position; and at least one moisture diverter, said at least one moisture diverter being engaged to said top cover in said lower section proximate to at least one of said plurality of horizontal supports, said at least one moisture diverter having a passage opening, a plurality of downwardly and converging passage walls, and a moisture chute, said moisture chute extending downwardly and outwardly relative to said plurality of passage walls, said moisture chute having a discharge opening, at least a portion of said moisture chute and said discharge opening extending through said at least one slot passage, wherein a volume of moisture contacting said cover exterior enters said passage opening, said volume of moisture being directed downwardly by said plurality of passage walls and into said moisture chute and outwardly from said discharge opening exterior to at least one of said plurality of side panels, said discharge opening being disposed between at least one of said plurality of side panels and said valence section.

2. The climate shelter according to claim 1, wherein said passage opening is triangular in shape.

3. The climate shelter according to claim 1, further comprising a moisture opening cover disposed over said passage opening.

4. The climate shelter according to claim 3, wherein said moisture chute is formed of fabric material and is tubular in shape.

5. The climate shelter according to claim 4, said moisture chute comprising hook and loop fabric material.

6. The climate shelter according to claim 5, said cover interior of said valence section comprising mating hook and loop fabric material.

7. The climate shelter according to claim 5, wherein said top cover is formed of fabric material.

8. The climate shelter according to claim 5, wherein said plurality of side panels are formed of fabric material.

9. The climate shelter according to claim 5, wherein said at least one moisture diverter is formed of fabric material.

10. A climate shelter comprising:

a frame structure, said frame structure having a plurality of vertical legs, a plurality of horizontal supports, and a plurality of cover supports, one of said plurality of horizontal supports extending between at least two adjacent of said plurality of vertical legs, and said plurality of cover supports extending angularly upwardly relative to said plurality of horizontal supports;

a top cover, said top cover having a cover interior and a cover exterior, said top cover having an upper section and a lower section, said top cover being disposed over said plurality of cover supports, said upper section being proximate to an upper area of said frame structure, said lower section being positioned proximate to and over at least one of said plurality of horizontal supports and extending downwardly therefrom establishing a valence section, said valence section having a bottom edge, said top cover having a horizontally extending top cover zipper section positioned proximate to and below at least one of said plurality of horizontal supports on said cover interior;

a plurality of vertical side panels, each of said plurality of side panels having a side panel top edge, a side panel left edge, and a side panel right edge, at least one of said side panel top edges having a side panel top zipper section, said side panel top zipper section being constructed and arranged for releasable engagement to at least one of said horizontally extending top cover zipper sections, at least one of said plurality of side panels having at least one slot passage, each of said at least one slot passages traversing said at least one of said plurality of side panels below said side panel top zipper section, said valence section being exterior relative to said side panel top zipper section, said at least one slot passage, and a portion of at least one of said plurality of side panels in a first operative position; and at least one moisture diverter, said at least one moisture diverter being engaged to said top cover, said at least one moisture diverter being positioned on said lower section between said upper section and at least one of said plurality of horizontal supports, said moisture diverter having a passage opening, a plurality of downwardly and inwardly converging passage walls, and a moisture chute in fluid flow communication with said plurality of passage walls, said moisture chute extending downwardly and outwardly relative to said plurality of passage walls, said moisture chute having a discharge opening, at least a portion of said moisture chute and said discharge opening extending through said at least one slot passage, wherein a volume of moisture contacting said cover exterior enters said moisture diverter through said passage opening, said volume of moisture being directed downwardly by said plurality of passage walls and into said moisture chute and outwardly from said discharge opening exterior to at least one of said plurality of side panels, said discharge opening being disposed between at least one of said plurality of side panels and said valence section, said bottom edge being disposed downwardly relative to said discharge opening.

11. A climate shelter comprising:

a frame structure, said frame structure having a plurality of vertical legs, a plurality of horizontal supports, and a plurality of cover supports;

a top cover, said top cover having a cover interior and a cover exterior, said top cover having a lower section, said top cover being disposed over said plurality of cover supports, said lower section being positioned proximate to and over at least one of said plurality of horizontal supports and extending downwardly therefrom establishing a valence section, said valence section having a bottom edge, said top cover having a horizontally extending top cover zipper section positioned proximate to and below at least one of said plurality of horizontal supports on said cover interior;

at least one vertical side panel, each of said at least one side panel having a side panel top edge, at least one of said side panel top edges having a side panel top zipper section, said side panel top zipper section being constructed and arranged for releasable engagement to at least one of said horizontally extending top cover zipper sections, at least one of said at least one side panels having at least one slot passage, each of said at least one slot passages traversing said at least one of said at least one side panel below said side panel top zipper section, said valence section being exterior relative to said side panel top zipper section, said at least one slot passage, and a portion of at least one of said at least one side panel in a first operative position; and at least one moisture diverter, said at least one moisture diverter being engaged to said top cover in said lower section proximate to at least one of said plurality of horizontal supports, said at least one moisture diverter having a passage opening, a downwardly and converging passage wall, and a moisture chute, said moisture chute extending downwardly and outwardly relative to said passage wall, said moisture chute having a discharge opening, at least a portion of said moisture chute and said discharge opening extending through said at least one slot passage, wherein a volume of moisture contacting said cover exterior enters said passage opening, said volume of moisture being directed downwardly by said passage wall and into said moisture chute and outwardly from said discharge opening exterior to at least one of said at least one side panel, said discharge opening being disposed between at least one of said at least one side panel and said valence section.

* * * * *